US006795659B2

(12) United States Patent
Uchida

(10) Patent No.: US 6,795,659 B2
(45) Date of Patent: Sep. 21, 2004

(54) IMAGE FORMING APPARATUS AND TROUBLE STATE NOTIFYING METHOD THEREOF

(75) Inventor: Noriko Uchida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/230,217

(22) Filed: Aug. 29, 2002

(65) Prior Publication Data

US 2003/0044187 A1 Mar. 6, 2003

(30) Foreign Application Priority Data

Aug. 31, 2001 (JP) ..... 2001-262567

(51) Int. Cl.[7] ..... G03G 15/00

(52) U.S. Cl. ..... 399/9; 399/21; 399/32; 399/33

(58) Field of Search ..... 399/8, 10, 11, 399/9, 21, 18, 15, 33, 32

(56) References Cited

U.S. PATENT DOCUMENTS 6,185,379 B1 * 2/2001 Lay et al. ..... 399/11

* cited by examiner

*Primary Examiner*—Susan S. Y. Lee
(74) *Attorney, Agent, or Firm*—Fitzpatrick, Cella, Harper & Scinto

(57) ABSTRACT

When an engine test print switch specifies execution of an image forming operation test mode, a trouble state of a printer engine is detected. Based on the trouble state detection result, a driving operation of a main motor is varied, and a notice of the trouble state of the printer engine is issued, thereby easily discriminating trouble contents by using only the printer engine without any personal computer or another specific jig, etc. when the printer engine falls in a trouble state.

20 Claims, 6 Drawing Sheets

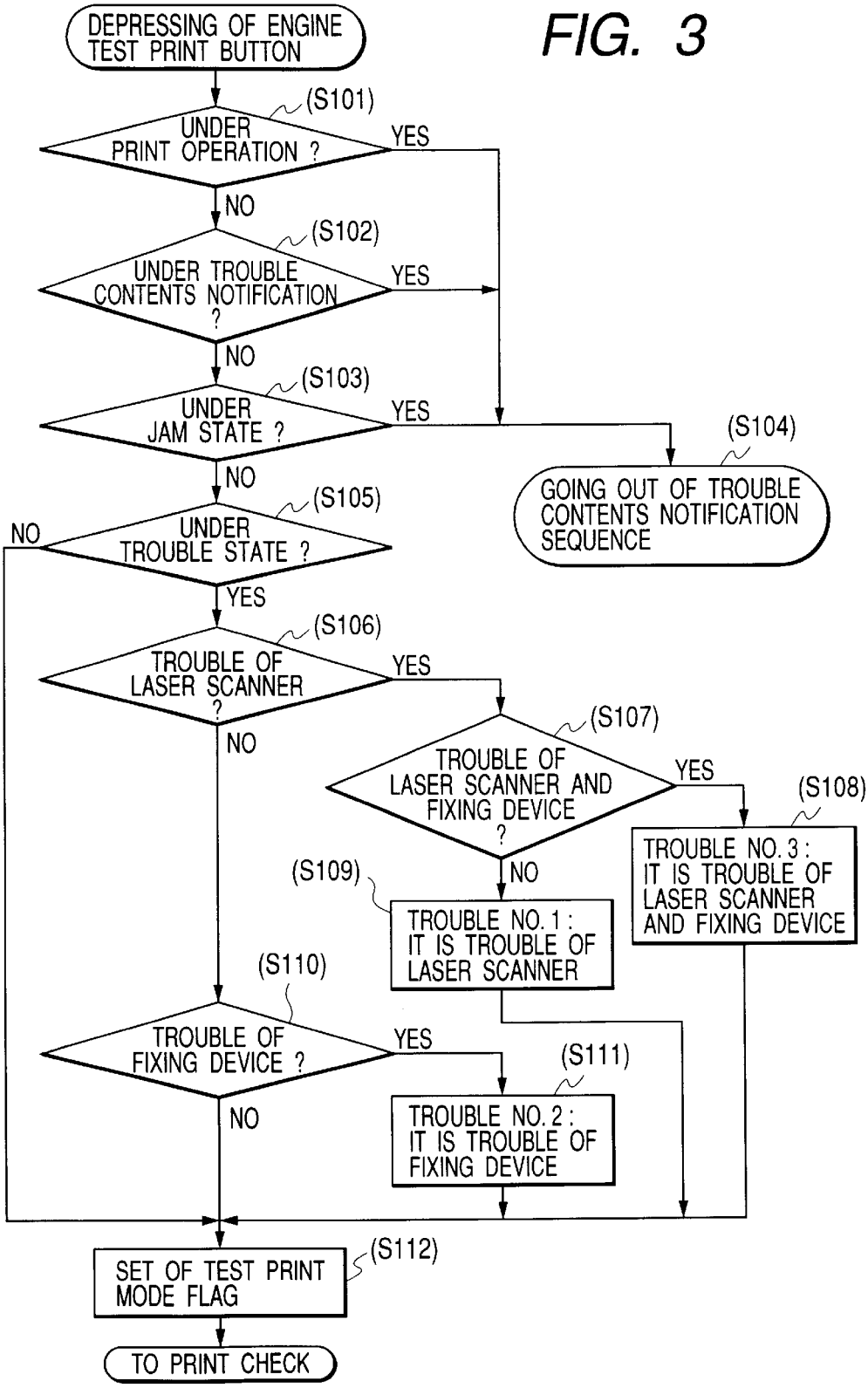
FIG. 3
DEPRESSING OF ENGINE TEST PRINT BUTTON
(S101)
UNDER PRINT OPERATION ?
YES
NO
(S102)
UNDER TROUBLE CONTENTS NOTIFICATION ?
YES
NO
(S103)
UNDER JAM STATE ?
YES
NO
(S104)
GOING OUT OF TROUBLE CONTENTS NOTIFICATION SEQUENCE
(S105)
UNDER TROUBLE STATE ?
NO
YES
(S106)
TROUBLE OF LASER SCANNER ?
YES
NO
(S107)
TROUBLE OF LASER SCANNER AND FIXING DEVICE ?
YES
NO
(S108)
TROUBLE NO. 3 : IT IS TROUBLE OF LASER SCANNER AND FIXING DEVICE
(S109)
TROUBLE NO. 1 : IT IS TROUBLE OF LASER SCANNER
(S110)
TROUBLE OF FIXING DEVICE ?
YES
NO
(S111)
TROUBLE NO. 2 : IT IS TROUBLE OF FIXING DEVICE
(S112)
SET OF TEST PRINT MODE FLAG
TO PRINT CHECK

IMAGE FORMING APPARATUS AND TROUBLE STATE NOTIFYING METHOD THEREOF

BACKGROUND OF THE INVENTION

1. Field of the Invention

The present invention relates to an image forming apparatus for forming an image mainly using an electrophotographic process, and a trouble state notifying method for use with the image forming apparatus.

2. Related Background Art

Conventionally, in an image forming apparatus such as a laser beam printer, etc. for use with an electrophotographic process, a common method of discriminating a trouble when the laser beam printer engine falls in a trouble state can be a method of discriminating it by an LCD display on the laser beam printer or by the display of an LED, LCD, etc. by depressing a reset switch, etc.

However, when a small device, etc. is designed, there are an increasing number of laser beam printers without a display unit such as an LCD, an LED, etc. to realize a smaller or less expensive unit. In this case, when a laser beam printer engine becomes faulty, a user or a service staff connects a personal computer or other jigs, etc. and confirms the fault.

However, in the conventional methods, there has been the problem that a user or a service staff has to connect a personal computer or another jig, etc. to discriminate a trouble when an engine, etc. of an image forming apparatus without a display unit such as an LCD or an LED commonly used in a small device, etc. or a reset switch, etc. falls in the trouble state.

SUMMARY OF THE INVENTION

The present invention has been achieved to solve the above mentioned problem.

The present invention aims at providing an image forming apparatus and a trouble state notifying method for use with the image forming apparatus capable of easily discriminating a trouble using only a printer engine without a personal computer or another specific jig, etc. when the printer engine falls in a trouble state.

According to the present invention, an image forming apparatus having image forming means for forming an image in a recording medium using an electrophotographic process, conveying means for conveying a recording medium fed to the image forming means, and drive means for driving the conveying means includes:

- instruction means for indicating execution of a test mode of an image forming operation;
- detection means for detecting a trouble state of the image forming means; and
- control means for sending a notice of a trouble state of the image forming means by varying driving operations of the drive means based on a trouble state detection result of the detection means when the instruction means indicates execution of a test mode of an image forming operation.

It is preferable that the control means sends a notice of a trouble state of the image forming means by varying the driving times of the drive means based on a trouble state detection result of the detection means.

It is preferable that the control means sends a notice of a trouble state of the image forming means by varying the driving frequencies of the drive means based on a trouble state detection result of the detection means.

It is preferable that the control means sends a notice of a trouble state of the image forming means by varying the driving times and frequencies of the drive means based on a trouble state detection result of the detection means.

It is preferable that the image forming means includes latent image forming means for forming an electrostatic latent image on a photosensitive member according to an input image signal, developing means for developing an electrostatic latent image formed on a photosensitive member by the latent image forming means using a developer; transfer means for transferring a developer image developed by the developing means on a conveyed recording medium; and fixing means for fixing the developer image transferred from the transfer means to a recording medium. The detection means detects a trouble state of the latent image forming means and a trouble state of the fixing means.

It is preferable that the control means sends a trouble state of the image forming means by varying the driving operations of the drive means with the detection result by the detection means indicating: a first trouble state in which only the latent image forming means is faulty; a second trouble state in which only the fixing means is faulty; and a third trouble state in which the latent image forming means and the fixing means are both faulty.

It is preferable that a display unit including an LCD or an LED is provided.

It is preferable that reset instruction means for indicating reactivation of the image forming means is provided.

The trouble state notifying method for use with the image forming apparatus according to the present invention having image forming means for forming an image in a recording medium using an electrophotographic process, conveying means for conveying a recording medium fed to the image forming means, and drive means for driving the conveying means includes:

- an indicating step of indicating execution of a test mode of an image forming operation;
- a detecting step of detecting a trouble state of the image forming means; and
- a notifying step of sending a notice of a trouble state of the image forming means by varying the driving operations of the drive means based on a trouble state detection result of the detecting step when the indicating step indicates execution of a test mode of an image forming operation.

According to the present invention, when the instruction means indicates the execution of the test mode of an image forming operation, the control means sends a notice of a trouble state of the image forming means by varying the operation of the drive means for driving the conveying means for conveying the recording medium to be fed to the image forming means based on a trouble state detection result of the image forming means for forming an image using an electrophotographic process by the detection means. Therefore, when the image forming means falls in a trouble state, the trouble can be easily discriminated only by the image forming apparatus without a personal computer or another special jig, etc.

Furthermore, when the control means sends a trouble state of the image forming means by varying the driving operations of the drive means with the detection result by the detection means indicating: a first trouble state in which only the latent image forming means is faulty; a second trouble state in which only the fixing means is faulty; and a third trouble state in which the latent image forming means and the fixing means are both faulty, the first to third trouble state can be easily discriminated only by the image forming apparatus without a personal computer or another special jig, etc. when the image forming means falls in a trouble state.

The above mentioned and other objects, features and advantages of the present invention will become more apparent by reference to the following detailed description of the invention taken in conjunction with the accompanying drawings.

BRIEF DESCRIPTION OF THE DRAWINGS

FIG. 3 is a flowchart of an example of a first control process procedure according to the image forming apparatus of the present invention;

DETAILED DESCRIPTION OF THE PREFERRED EMBODIMENTS

The embodiments of the present invention will be described below by referring to the attached drawings.

First Embodiment

Figure 1:
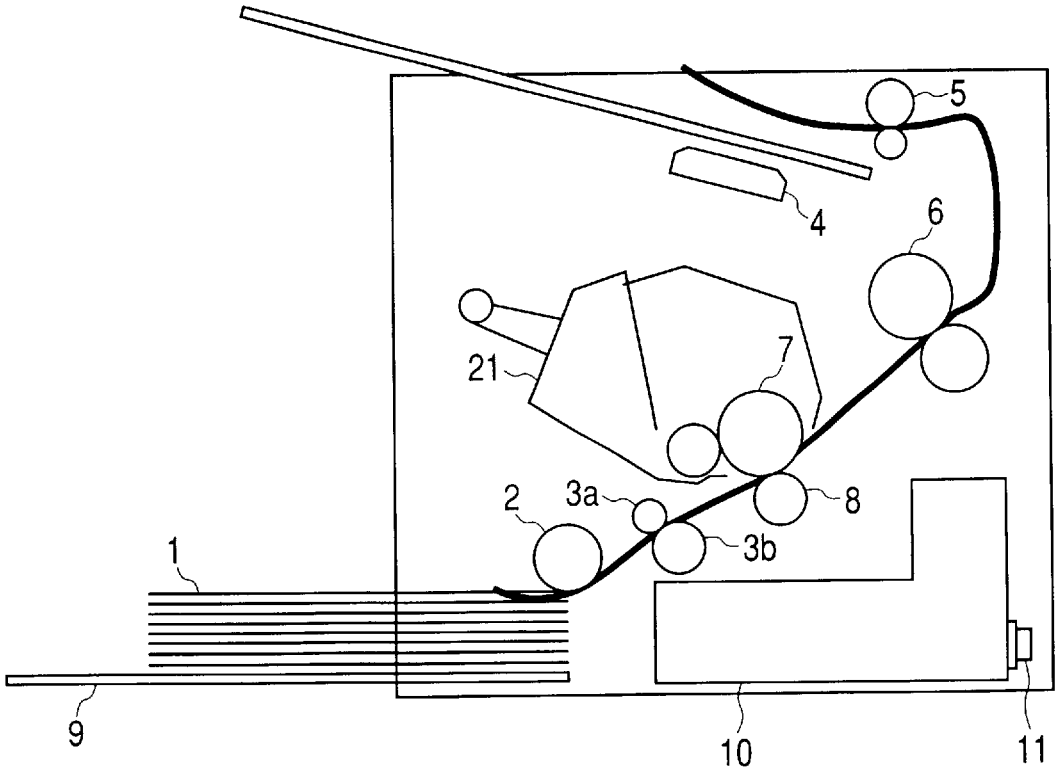
FIG. 1 is a sectional view of a configuration of an engine of a laser beam printer to which an image forming apparatus according to a first embodiment of the present invention can be applied.
Figure 2:
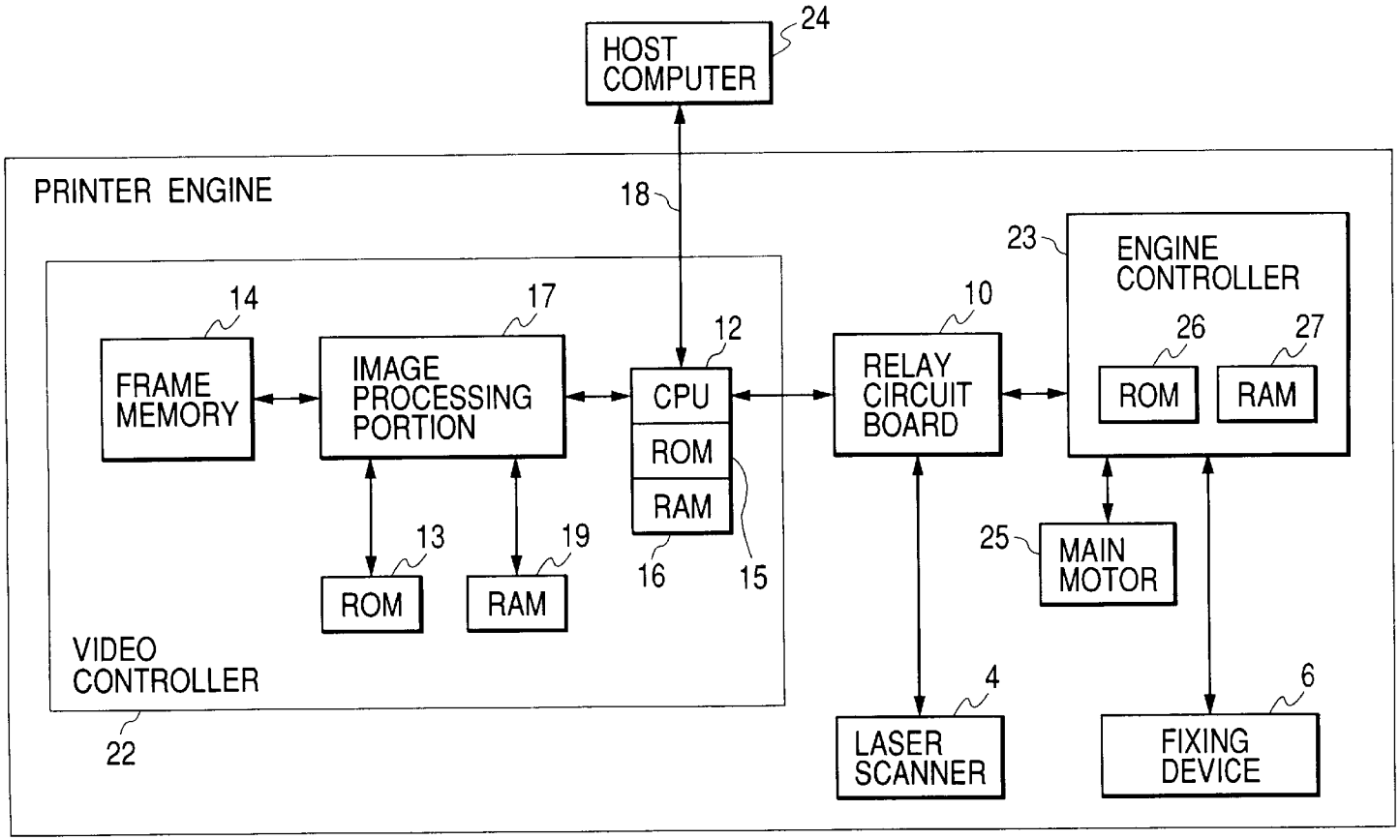
FIG. 2 is a block diagram of a configuration of a control of the laser beam printer shown in FIG. 1.

FIG. 1 is a sectional view of a configuration of an engine of a laser beam printer (hereinafter, referred to as LBP) to which an image forming apparatus according to a first embodiment of the present invention can be applied. FIG. 2 is a block diagram of a configuration of a control of an LBP shown in FIG. 1, and the same reference numerals are used for the components appearing in FIGS. 1 and 2. The descriptions will be given below by referring to these drawings.

The LBP forms an image on a recording paper 1 in the electrophotographic process, and comprises a laser scanner 4 for scanning exposure on the photosensitive member (photosensitive drum) 7, a developer 21, a transfer roller 8, and a fixing device 6.

The laser scanner 4 performs a scan exposing process on the photosensitive member (photosensitive drum) 7 by directing right and left a laser beam emitted from a semiconductor laser (not shown in the attached drawings) according to a video signal described later. Thus, an electrostatic latent image such as a character pattern is formed on the photosensitive member (photosensitive drum) 7. The latent image is developed by a predetermined developer (toner) by the developer 21 provided around the photosensitive member 7, and then transferred by the transfer roller 8 to the recording sheet 1.

It is preferable that the recording sheet 1 is a bundle of cut sheets, and stored in a paper cassette 9 mounted in the LBP. The recording sheet 1 is led into the apparatus by a sheet feeding roller 2, a conveying roller 3*a*, and a conveying roller 3*b*, and fed to the photosensitive member 7.

The developer image electrostatically transferred by the electrified transfer roller 8 to the recording sheet 1 is fixed by the fixing device 6 to the recording sheet 1 by heat and pressure, and discharged outside the apparatus by a sheet discharging roller 5.

The LBP is also provided with the photosensitive member (photosensitive drum) 7, the sheet feeding roller 2, the conveying rollers 3*a* and 3*b*, the transfer roller 8, the main motor 25 for driving the rotation of the sheet discharging roller 5, etc. (FIG. 2)

Furthermore, the engine shown in FIG. 1 is provided with an engine test print switch 11. When the engine test print switch 11 is depressed, a test mode of an image forming operation is entered and a predetermined test printing process is performed. As described later, according to the present embodiment, if the engine test print switch 11 is depressed in a trouble state, then the operation of the main motor 25 is changed depending on the trouble contents, thereby sending a notice of the trouble contents to the user or the service staff.

As shown in FIG. 2, the LBP is electrically configured by a video controller 22 and an engine controller 23. A relay circuit board 10 connects the video controller 22, the engine controller 23, and the laser scanner 4. The above mentioned engine test print switch 11 is provided on the relay circuit board 10, but can also be provided on the engine controller 23 or in another printer engine.

The video controller 22 comprises a CPU 12, ROM 15 storing a control program, and RAM 16 used as a register, etc. When coded image information (code data) is received from a host computer, etc. through an external interface 18, the code data is transmitted to an image processing portion 17. The image processing portion 17 stores the code data in RAM 19, analyzes the code data, reads data from a character font stored in ROM 13 as necessary, converts the code data into video data and stores the converted data in frame memory 14. When a page of video data is stored in the frame memory 14, the CPU 12 issues a print instruction to the engine controller 23 through the relay circuit board 10 so that the video data stored in the frame memory 14 can be transmitted as a video signal sequentially to the engine controller 23 in synchronization with a main/sub scanning synchronization signal from the engine controller 23.

The CPU 12 can be communicated with a host computer 24 through the external interface 18, and the information, etc. in a program can be communicated to the host computer 24.

On the other hand, the engine controller 23 detects various information (such as an existence of the operation of depressing the engine test print switch 11, the operating state of the printer engine, a jam state, a trouble state of a laser scanner, an open/close state of a door, a trouble state of a fixing device, etc.).

The troubles of a laser beam printer using the above mentioned electrophotographic process can be troubles of the laser scanner 4 and the fixing device 6, and can be classified into three types of trouble contents, that is, a trouble of the laser scanner 4, a trouble of the fixing device 6, and a trouble of both laser scanner 4 and fixing device 6.

When any of the above mentioned troubles occurs, the LBP normally stops its operation. Therefore, a user or a service staff cannot recognize which trouble stops the operation. Described below is the operation of notifying the user or the service staff in the above mentioned case.

FIG. 3 is a flowchart of an example of a first control process procedure according to the image forming apparatus of the present invention, and corresponds to a trouble contents discrimination sequence in the trouble contents notification sequence performed when the engine test print switch 11 is depressed in the laser beam printer engine trouble state of the image forming apparatus shown in FIG. 1. The process of the flowchart is performed by the engine controller 23 based on the program stored in ROM 26 in the engine controller 23. S101 to S112 indicate the respective steps. When the engine test print switch 11 shown in FIG. 1 is depressed, the operation state of the LBP is checked in steps S101 to S103 whether the LBP is in the process of printing, sending a notice of trouble contents, or jamming (steps S101 to S103). If a check result is YES (that is, any of 'printing', 'sending a notice of trouble contents', or 'jamming' is output), then control is passed to step S104 to exit the trouble contents notification sequence.

On the other hand, if a check result is NO, that is, the LBP is not 'printing', 'sending a notice of trouble contents', or 'jamming' (that is, it is not in the process of 'printing', 'sending a notice of trouble contents', or 'jamming'), then control is passed to step S105, and it is determined whether or not it is in a trouble state.

If it is determined in step S105 that the unit is in a trouble state, control is passed to enter the trouble state discrimination sequence in steps S106 to S111).

In the trouble state discrimination sequence in steps S106 to S111, a current trouble is classified into trouble No. 1 'laser scanner trouble', trouble No. 2 'fixing device trouble', and trouble No. 3 'laser scanner and fixing device trouble', and control is passed to step S112.

In detail, it is determined in step S106 whether or not a laser scanner is faulty. If it is determined that the laser scanner is faulty, then it is determined in step S107 whether or not both laser scanner and fixing device are faulty. If it is determined that both laser scanner and fixing device are faulty, then an existing trouble is classified into a trouble No. 3 'both laser scanner and fixing device are faulty' (S108), and control is passed to step S112.

On the other hand, in step S107 if it is determined that the laser scanner and fixing device are not faulty, then the existing trouble is classified into a trouble NO. 1 'laser scanner trouble' (S109), thereby passing control to step S112.

In step S106, if it is determined that the laser scanner is not faulty, then it is determined whether or not the fixing device is faulty in step S110. If it is determined that the fixing device is faulty, then the existing trouble is classified into trouble No. 2 'fixing device trouble' (S111), and control is passed to step S112.

Figure 4:
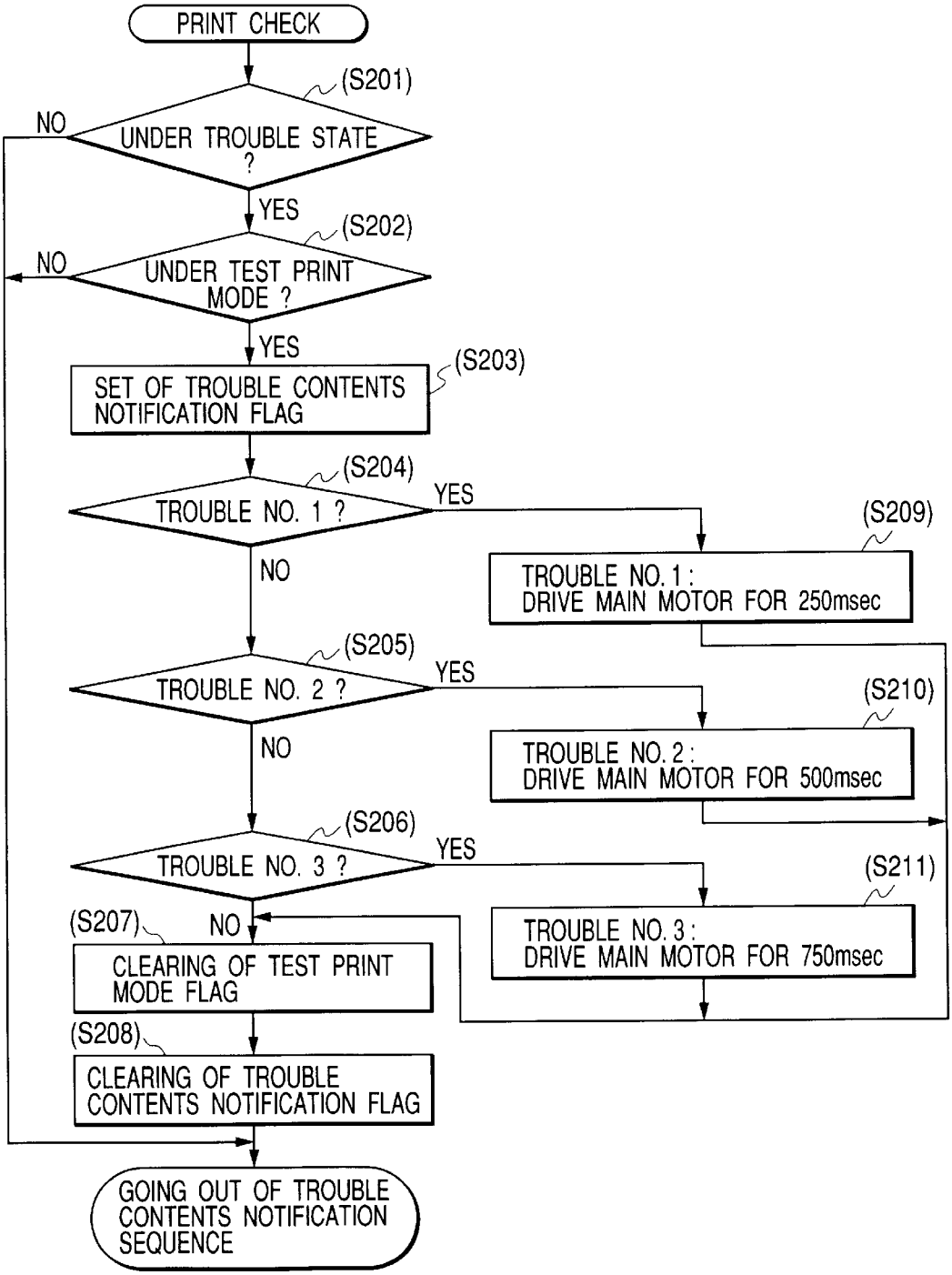
FIG. 4 is a flowchart of an example of a second control process procedure according to the image forming apparatus of the present invention.

Then, in step S112, a test print mode flag stored in RAM 27 in the engine controller 23 shown in FIG. 2 is set, and control is passed to the print check sequence shown in FIG. 4.

FIG. 4 is a flowchart of an example of a second control process procedure according to the image forming apparatus of the present invention, and corresponds to the print check sequence in the trouble contents notification sequence when the engine test print switch 11 is depressed in the laser beam printer engine trouble state of the image forming apparatus shown in FIG. 1. The process of the flowchart is performed by the engine controller 23 shown in FIG. 2 based on the program stored in the ROM 26 in the engine controller. S201 to S211 indicate the respective steps.

In step S201, it is checked again whether or not it is a trouble state. If it is determined that it is in a trouble state, then it is checked in step S202 whether or not it is in a test print mode. If it is determined that it is in a test print mode, then control is passed to the trouble contents notification sequence in steps S203 to S211.

In detail, in step S203, the trouble contents notification flag stored in the RAM 27 in the engine controller 23 shown in FIG. 2 is set, and it is determined in step S204 to S206 into which the trouble contents can be classified, trouble No. 1 'laser scanner trouble', trouble No. 2 'fixing device trouble', or trouble No. 3 'laser scanner and fixing device trouble' in the trouble contents check sequence shown in FIG. 3.

If it is determined that the trouble contents is classified into the trouble No. 1 (laser scanner trouble) (S204) in the trouble contents check sequence shown in FIG. 3, then the main motor is driven for 250 msec (S209). If it is determined that the trouble contents is classified into the trouble No. 2 (fixing device trouble) (S205), then the main motor is driven for 500 msec (S210). If it is determined that the trouble contents is classified into the trouble No. 3 (laser scanner and fixing device trouble) (S206), then the main motor is driven for 750 msec (S211), thereby passing control to step S207.

Then, in step S207, a test print mode flag is cleared, and the trouble contents notification flag is cleared in step S208, thereby exiting the trouble contents notification sequence.

On the other hand, if it is determined in step S202 that it is not in a test print mode, or if it is determined in step S201 that it is not in a trouble state, then control exits the trouble contents notification sequence.

Thus, by depressing the engine test print switch in a trouble state, the user or the service staff can be easily notified of a trouble contents in the driving time of the main motor (by variations of the driving time of the main motor depending on the trouble contents, that is, 250 msec for trouble No. 1 (laser scanner trouble), 500 msec for trouble No. 2 (fixing device trouble), and 750 msec for trouble No. 3 (laser scanner and fixing device trouble).

The trouble contents notification sequence is effective only in a trouble state. If the engine test print switch 11 is depressed in a normal state, (that is, if it is determined in step S201 that it is not in a trouble state), then an engine test printing process is performed after exiting the trouble contents notification sequence, and the test print mode flag is cleared.

Second Embodiment

In the above mentioned first embodiment, when the engine test print switch is depressed in a trouble state, the driving time of the main motor is varied depending on the trouble state, but the driving frequency of the main motor can be varied depending on the trouble contents. The embodiment will be described below.

Figure 5:
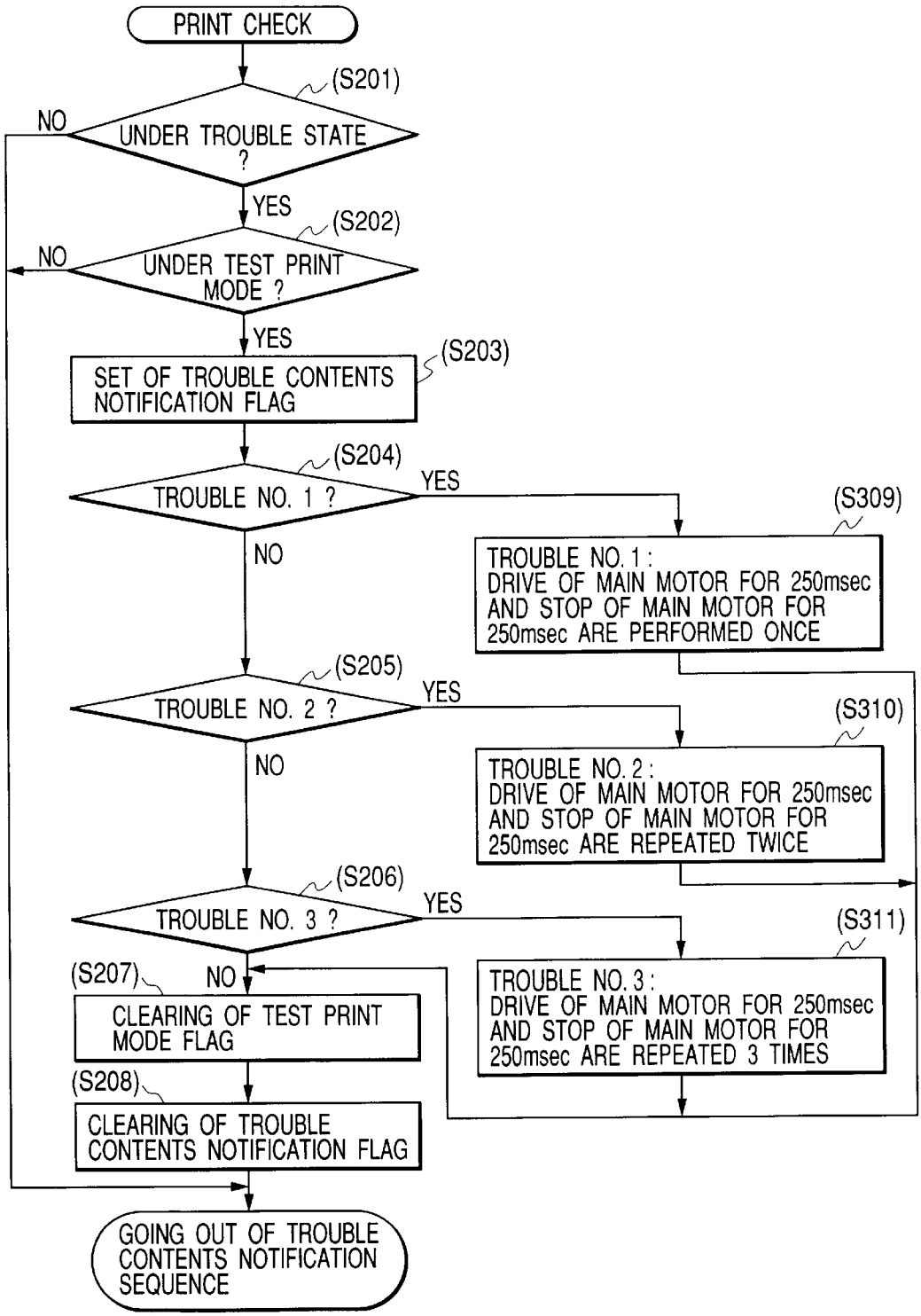
FIG. 5 is a flowchart of an example of a third control process procedure according to the image forming apparatus of the present invention.

FIG. 5 is a flowchart of an example of a third control process procedure according to the image forming apparatus of the present invention, and corresponds to the print check sequence in the trouble contents notification sequence when the engine test print switch 11 is depressed in the laser beam printer engine trouble state of the image forming apparatus shown in FIG. 1. The process of the flowchart is performed by the engine controller 23 shown in FIG. 2 based on the program stored in the ROM 26 in the engine controller. S201 to S208 and S309 to S311 indicate the respective steps, and the steps appearing in FIGS. 4 and 5 are assigned the same step numbers.

As in the first embodiment, in step S201, it is checked again whether or not it is a trouble state. If it is determined that it is in a trouble state, then it is checked in step S202 whether or not it is in a test print mode. If it is determined that it is in a test print mode, then control is passed to the trouble contents notification sequence in steps S203 to S208 and S309 to S311.

In detail, in step S203, the trouble contents notification flag stored in the RAM 19 shown in FIG. 2 is set, and it is determined in step S204 to S206 into which the trouble contents can be classified, trouble No. 1 'laser scanner trouble', trouble No. 2 'fixing device trouble', or trouble No. 3 'laser scanner and fixing device trouble' in the trouble contents check sequence shown in FIG. 3.

If it is determined that the trouble contents is classified into the trouble No. 1 (laser scanner trouble) (S204) in the trouble contents check sequence shown in FIG. 3, then the main motor is driven for 250 msec, stopped 250 msec (S309). If it is determined that the trouble contents is classified into the trouble No. 2 (fixing device trouble) (S205), then the main motor is driven for 250 msec, and stopped for 250 msec. This process is repeated twice (S310). If it is determined that the trouble contents is classified into the trouble No. 3 (laser scanner and fixing device trouble) (S206), then the main motor is driven for 250 msec, and stopped for 250 msec. This process is repeated three times (S311), thereby passing control to step S210.

Then, as in the first embodiment, a test print mode flag is cleared in step S207, and the trouble contents notification flag is cleared in step S208, thereby exiting the trouble contents notification sequence.

On the other hand, if it is determined in step S202 that it is not in a test print mode, or if it is determined in step S201 that it is not in a trouble state, then control exits the trouble contents notification sequence.

Thus, by depressing the engine test print switch in a trouble state, the user or the service staff can be easily notified of a trouble contents in the driving frequency of the main motor (by variations of the driving frequency of the main motor, that is, driving for 250 msec and stopping for 250 msec for trouble No. 1 (laser scanner trouble), driving for 250 msec and stopping for 250 msec, which is repeated twice, for trouble No. 2 (fixing device trouble), and driving for 250 msec and stopping for 250 msec, which is repeated three times, for trouble No. 3 (laser scanner and fixing device trouble).

The trouble contents notification sequence is effective only in a trouble state. If the engine test print switch 11 is depressed in a normal state, (that is, if it is determined in step S201 that it is not in a trouble state), then an engine test printing process is performed after exiting the trouble contents notification sequence, and the test print mode flag is cleared as in the first embodiment.

Third Embodiment

When the engine test print switch 11 is depressed in a trouble state, the driving time of the main motor is varied in the above mentioned first embodiment, and the driving frequency of the main motor is varied in the above mentioned second embodiment depending on the trouble state, but the driving time and frequency (driving operation (driving pattern)) of the main motor can be varied depending on the trouble contents. The embodiment is described below.

Figure 6:
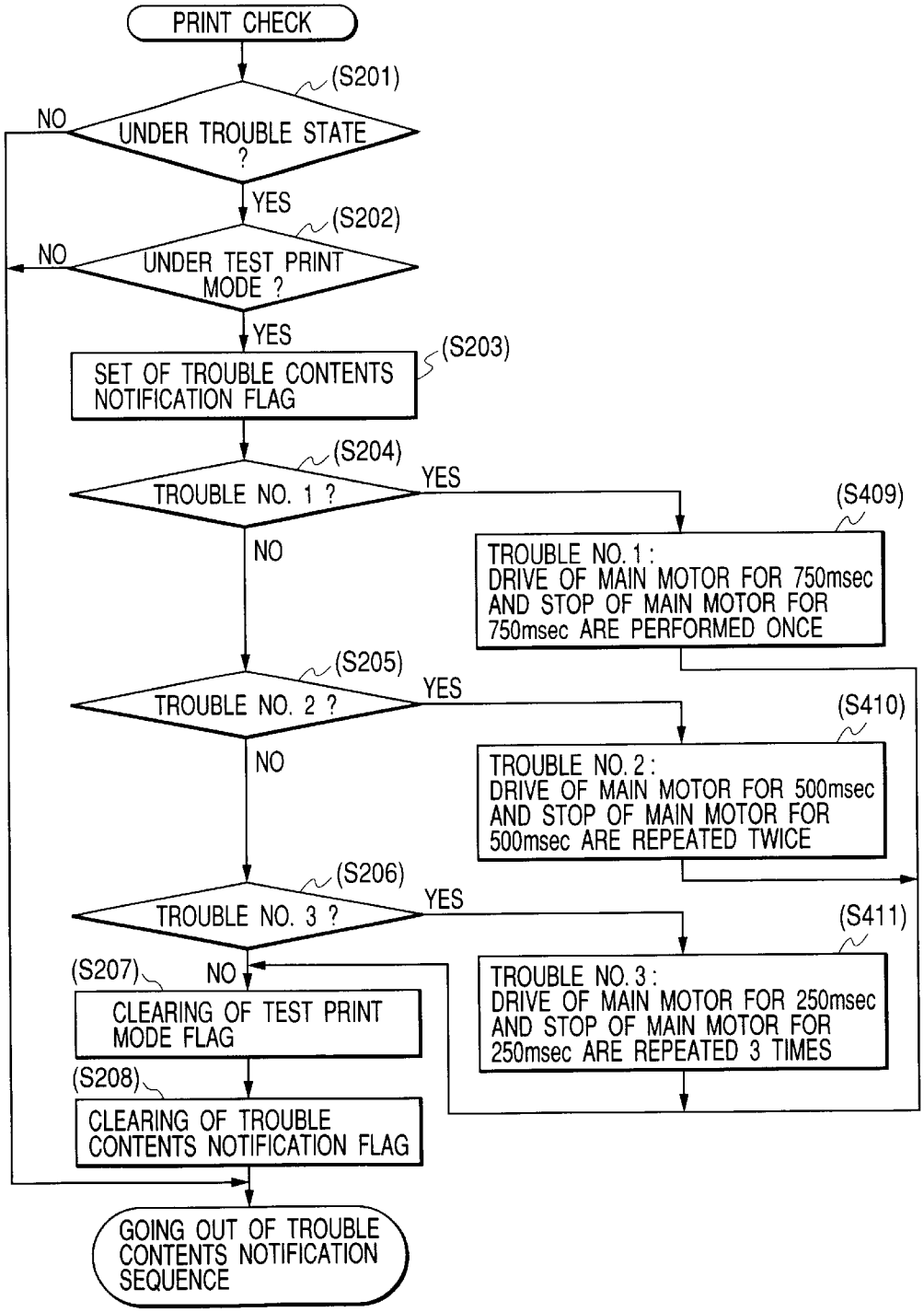
FIG. 6 is a flowchart of an example of a fourth control process procedure according to the image forming apparatus of the present invention.

FIG. 6 is a flowchart of an example of a fourth control process procedure according to the image forming apparatus of the present invention, and corresponds to the print check sequence in the trouble contents notification sequence when the engine test print switch 11 is depressed in the laser beam printer engine trouble state of the image forming apparatus shown in FIG. 1. The process of the flowchart is performed by the engine controller 23 shown in FIG. 2 based on the program stored in the ROM 26 in the engine controller. S201 to S208 and S409 to S411 indicate the respective steps, and the steps appearing in FIGS. 4, 5, and 6 are assigned the same step numbers.

As in the first and second embodiments, in step S201, it is checked again whether or not it is a trouble state. If it is determined that it is in a trouble state, then it is checked in step S202 whether or not it is in a test print mode. If it is determined that it is in a test print mode, then control is passed to the trouble contents notification sequence in steps S203 to S208 and S309 to S311.

In detail, in step S203, the trouble contents notification flag stored in the RAM 27 in the engine controller 23 shown in FIG. 2 is set, and it is determined in step S204 to S206 into which the trouble contents can be classified, trouble No. 1 'laser scanner trouble', trouble No. 2 'fixing device trouble', or trouble No. 3 'laser scanner and fixing device trouble' in the trouble contents check sequence shown in FIG. 3.

If it is determined that the trouble contents is classified into the trouble No. 1 (laser scanner trouble) (S204) in the trouble contents check sequence shown in FIG. 3, then the main motor is driven for 750 msec, stopped 750 msec (S409). If it is determined that the trouble contents is classified into the trouble No. 2 (fixing device trouble) (S205), then the main motor is driven for 500 msec, and stopped for 500 msec. This process is repeated twice (S410). If it is determined that the trouble contents is classified into the trouble No. 3 (laser scanner and fixing device trouble) (S206), then the main motor is driven for 250 msec, and stopped for 250 msec. This process is repeated three times (S411), thereby passing control to step S207.

Then, as in the first and second embodiments, a test print mode flag is cleared in step S207, and the trouble contents notification flag is cleared in step S208, thereby exiting the trouble contents notification sequence.

On the other hand, if it is determined in step S202 that it is not in a test print mode, or if it is determined in step S201 that it is not in a trouble state, then control exits the trouble contents notification sequence.

Thus, by depressing the engine test print switch in a trouble state, the user or the service staff can be easily notified of a trouble contents in the driving time and the driving frequency (driving operation (driving pattern)) of the main motor (by variations of the driving frequency of the main motor, that is, driving for 750 msec and stopping for 750 msec for trouble No. 1 (laser scanner trouble), driving for 500 msec and stopping for 500 msec, which is repeated twice, for trouble No. 2 (fixing device trouble), and driving for 250 msec and stopping for 250 msec, which is repeated three times, for trouble No. 3 (laser scanner and fixing device trouble).

The trouble contents notification sequence is effective only in a trouble state. If the engine test print switch 11 is depressed in a normal state, (that is, if it is determined in step S201 that it is not in a trouble state), then an engine test printing process is performed normally after exiting the trouble contents notification sequence, and the test print mode flag is cleared as in the first and second embodiments.

In the trouble state as described above, the user or a service staff can be easily notified of the trouble contents by varying the driving operation (driving pattern) of the main motor in a driving time, a driving frequency, or a driving time and frequency, etc. by depressing the engine test print switch 11.

Therefore, although the image forming apparatus using an electrophotographic process becomes faulty, only the above mentioned engine can easily discriminate the trouble contents by depressing the engine test print switch of the image forming apparatus engine without a personal computer or another specific jig, etc.

Additionally, the above mentioned trouble contents notification sequence is very effective in the image forming apparatus having no trouble detecting capability in a single engine widely used for a small device, etc. (that is, an image forming apparatus having no display unit such as an LCD, an LED, etc. and a reset switch, etc. for initializing (reactivating) a printer engine, and not capable of discriminating a trouble state by the display such as an LED, LCD, etc. generated by depressing a reset switch, etc.). However, it can also be configured such that the above mentioned trouble contents notification sequence can be applied to a medium device and a large device having a display unit such as an LCD, an LED, a reset switch, etc. Accordingly, it is also effective in a medium device and a large device having a display unit such as the LCD, LED, etc. and a reset switch, etc. In this case, a notice of the trouble state can be sent by the display on the LED, LCD, etc., and the driving operation (driving pattern) can be varied in driving time, driving frequency, or driving time and driving frequency.

In each of the above mentioned embodiments, the method of discriminating and informing of three trouble contents is described. However, the trouble contents are not limited to the three troubles of 'laser scanner trouble', 'fixing device trouble', and 'laser scanner and fixing device trouble', but the trouble contents and the driving operation (driving pattern) can be associated with each other and notified although the trouble contents increases in the future and such a case is included in this invention. As a result, the present invention is promising.

Furthermore, the driving operation (driving pattern) is not limited to the above mentioned driving operation (driving pattern). For example, the driving operation (driving pattern) can be: in the case of the trouble No. 1 (laser scanner trouble), 'driving for 750 msec, stopping for 500 msec, driving for 500 msec, stopping for 250 msec, driving for 250 msec, and stopping for 250 msec in a decreasing mode'; in the case of the trouble No. 2 (fixing device trouble), 'driving for 500 msec and stopping for 500 msec in a constant mode', which is repeated three times; and in the case of the trouble No. 3 (laser scanner and fixing device trouble), 'driving for 250 msec, stopping for 250 msec, driving for 500 msec, stopping for 500 msec, driving for 750 msec, and stopping for 750 msec in an increasing mode'. Furthermore, other driving times and driving frequencies may be accepted.

Furthermore, in an image forming apparatus using a printing system other than the electrophotographic process system, for example, an ink jet system, a heat transfer system, a sublimation system, etc., a notice of a detected trouble state can be reported by varying the driving operation (driving pattern) of the main motor based on the detected trouble state when any trouble is detected. According to the present embodiment, the main motor 25 drives the rotation of the photosensitive member (photosensitive drum) 7, the sheet feeding roller 2, the conveying rollers 3*a* and 3*b*, the transfer roller 8, the sheet discharging roller 5, etc. However, in a device having a plurality of motors, a motor is not limited to one for driving the rotation of the photosensitive drum, but can vary the driving pattern of a sheet feeding motor, a conveying motor, etc. depending on the troubles.

As described above, when an image forming apparatus such as a laser beam printer, etc. having a engine test print switch 11 shown in FIG. 1 and using an electrophotographic process falls in a trouble state, the trouble contents can be easily discriminated without a personal computer or another specific jig, etc. by the function of sending a notice of the trouble contents to a user or a service staff by the operation of the main motor after depressing the engine test print switch 11. Thus, according to the embodiments of the present invention, the engine test print switch 11 shown in FIG. 1 is not only used in an engine test printing process in a normal state, but also used as means for notifying a user or a service staff of the trouble contents in a trouble state.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus having image forming means for forming an image in a recording medium using an electrophotographic process, conveying means for conveying a recording medium fed to the image forming means, and drive means for driving the conveying means, comprising:

instruction means for indicating execution of a test mode of an image forming operation;

detection means for detecting a trouble state of said image forming means; and control means for sending a notice of a trouble state of said image forming means by varying driving operations of said drive means based on a trouble state detection result of said detection means when said instruction means indicates execution of a test mode of an image forming operation.

2. The image forming apparatus according to claim 1, wherein said control means sends a notice of a trouble state of said image forming means by varying the driving times of said drive means based on a trouble state detection result of said detection means.

3. The image forming apparatus according to claim 1, wherein said control means sends a notice of a trouble state of said image forming means by varying the driving frequencies of said drive means based on a trouble state detection result of said detection means.

4. The image forming apparatus according to claim 1, wherein said control means sends a notice of a trouble state of said image forming means by varying the driving times and frequencies of said drive means based on a trouble state detection result of said detection means.

5. The image forming apparatus according to claim 1, wherein said image forming means comprises:

latent image forming means for forming an electrostatic latent image on a photosensitive member according to an input image signal;

developing means for developing an electrostatic latent image formed on a photosensitive member by said latent image forming means using a developer;

transfer means for transferring a developer image developed by the developing means on a conveyed recording medium; and fixing means for fixing said developer image transferred from said transfer means to a recording medium, wherein said detection means detects a trouble state of said latent image forming means and a trouble state of said fixing means.

6. The image forming apparatus according to claim 5, wherein said control means sends a notice of a trouble state of said image forming means by varying the driving operations of said drive means with the detection result by said detection means indicating: a first trouble state in which only latent image forming means is faulty; a second trouble state in which only fixing means is faulty; and a third trouble state in which said latent image forming means and said fixing means are both faulty.

7. The image forming apparatus according to claim 1, further comprising a display unit having an LCD or an LED.

8. The image forming apparatus according to claim 1, further comprising reset instruction means for indicating reactivation of said image forming means.

9. A trouble state notifying method for use with an image forming apparatus having image forming means for forming an image in a recording medium using an electrophotographic process, conveying means for conveying a recording medium fed to the image forming means, and drive means for driving the conveying means, comprising:

an indicating step of indicating execution of a test mode of an image forming operation;

a detecting step of detecting a trouble state of the image forming means; and a notifying step of sending a notice of a trouble state of the image forming means by varying the driving operations of the drive means based on a trouble state detection result of said detecting step when said indicating step indicates execution of a test mode of an image forming operation.

10. An image forming apparatus, comprising:

image forming means for forming an image;

drive means for driving a movable portion of said image forming means;

operating portion operated by an operator;

detection means for detecting plural types of trouble states of said image forming means;

classifying means for classifying a trouble state based on the plural types of trouble states detected by said detection means; and control means for driving said drive means in various aspects depending on a classification result by said classifying means when said operating portion is predeterminately operated in a trouble state of said image forming apparatus.

11. An image forming apparatus having an image forming unit for forming an image on a recording medium using an electrophotographic process, a conveying system for conveying a recording medium fed to the image forming unit, and a driving unit for driving the conveying system, comprising:

an instruction unit for indicating execution of a test mode of an image forming operation;

a detector for detecting a trouble state of the image forming unit; and a controller for sending a notice of a trouble state of the image forming unit by varying driving operations of said driving unit based on a trouble state detection result of said detector when said instruction unit indicates execution of a test mode of an image forming operation.

12. The image forming apparatus according to claim 11, wherein said controller sends a notice of a trouble state of the image forming unit by varying the driving times of said driving unit based on a trouble state detection result of said detector.

13. The image forming apparatus according to claim 11, wherein said controller sends a notice of trouble state of the image forming unit by varying the driving frequencies of said driving unit based on a trouble state detection result of said detector.

14. The image forming apparatus according to claim 11, wherein said controller sends a notice of a trouble state of the image forming unit by varying the driving times and frequencies of said driving unit based on a trouble state detection result of said detector.

15. The image forming apparatus according to claim 11, wherein the image forming unit comprises:

a latent image forming unit for forming an electrostatic latent image on a photosensitive member according to an input image signal;

a developing unit for developing an electrostatic latent image formed on the photosensitive member by said latent image forming unit using a developer;

a transfer unit for transferring a developer image developed by said developing unit on a convey recording medium; and a fixing unit for fixing the developer image transferred from said transfer unit to a recording medium, wherein said detector detects a trouble state of said latent image forming unit and a trouble state of said fixing unit.

16. The image forming apparatus according to claim 15, wherein said controller sends a notice of a trouble state of the image forming unit by varying the driving operations of said driving unit with the detection result by said detector indicating:

a first trouble state in which only said latent image forming unit is faulty;

a second trouble state in which only said fixing unit is faulty;

and a third trouble state in which said latent image forming unit and said fixing unit are both faulty.

17. The image forming apparatus according to claim 11, further comprising a display unit having an LCD or and LED.

18. The image forming apparatus according to claim 11, further comprising a reset instruction unit for indicating reactivation of the image forming unit.

19. A trouble state notifying method for use with an image forming apparatus having an image forming unit for forming an image on a recording medium using an electrophotographic process, a conveying system for conveying a recording medium fed to the image forming unit, and a driving unit for driving the conveying system comprising:

an indicating step of indicating execution of a test mode of an image forming operation;

a detecting step of detecting a trouble state of the image forming unit; and a notifying step of sending a notice of a trouble state of the image forming unit by varying the driving operation of the driving unit based on a trouble state detection result of said detecting step when said indicating step indicates execution of a test mode of an image forming operation.

20. An image forming apparatus, comprising:

an image forming unit for forming an image;

a driving unit for driving a movable portion of said image forming unit;

an operating portion operated by an operator;

a detector for detecting plural types of trouble states of said image forming unit;

a classifier for classifying a trouble state based on the plural types of trouble states detected by said detector; and a controller for driving said driving unit in various aspects depending on a classification result by said classifier when said operating portion is predeterminately operated in a trouble state of said image forming apparatus.

* * * * *

UNITED STATES PATENT AND TRADEMARK OFFICE

CERTIFICATE OF CORRECTION

PATENT NO. : 6,795,659 B2
DATED : September 21, 2004
INVENTOR(S) : Noriko Uchida It is certified that error appears in the above-identified patent and that said Letters Patent is hereby corrected as shown below:

Column 12,
Line 30, “and” should read -- an --.

Signed and Sealed this

Fourth Day of January, 2005

JON W. DUDAS
*Director of the United States Patent and Trademark Office*